US008162803B2

(12) United States Patent
Schroeder et al.

(10) Patent No.: US 8,162,803 B2
(45) Date of Patent: Apr. 24, 2012

(54) MAGNETIC RESISTANCE TRAINER POWER MEASUREMENT

(75) Inventors: Brady M. Schroeder, Milton, GA (US); Niko Austin Henderson, Scotts Valley, CA (US)

(73) Assignee: Bell Sports, Inc., Scotts Valley, CA (US)

( * ) Notice: Subject to any disclaimer, the term of this patent is extended or adjusted under 35 U.S.C. 154(b) by 121 days.

(21) Appl. No.: 12/701,113

(22) Filed: Feb. 5, 2010

(65) Prior Publication Data

US 2011/0195818 A1 Aug. 11, 2011

(51) Int. Cl.
*A63B 71/00* (2006.01)

(52) U.S. Cl. ..... 482/5; 482/1; 482/8; 482/9; 482/901

(58) Field of Classification Search ..... 482/1–9, 482/900–902, 51, 57; 434/247; 73/379.01–379.03
See application file for complete search history.

(56) References Cited

U.S. PATENT DOCUMENTS 5,656,001 A 8/1997 Baatz ..... 482/61
7,585,258 B2 * 9/2009 Watson et al. ..... 482/63
7,976,434 B2 * 7/2011 Radow et al. ..... 482/8
2008/0096725 A1 * 4/2008 Keiser ..... 482/8
2009/0118099 A1 * 5/2009 Fisher et al. ..... 482/5

OTHER PUBLICATIONS http://en.wikipedia.org/wiki/Hall_effect_sensor ; "Hall Effect Sensor"; Wikipedia; pp. 3, Dec. 16, 2010.

* cited by examiner

*Primary Examiner* — Glenn Richman
(74) *Attorney, Agent, or Firm* — Baker Botts L.L.P.

(57) ABSTRACT

A magnetic resistance trainer includes an electrically conductive disk configured to rotate in response to power provided by a user of the trainer. The trainer further includes a magnet creating a magnetic field. The magnet is configured to be positioned proximate the disk such that the magnetic field induces eddy currents in the disk when the disk is rotating. Also, the trainer includes a sensor system configured to detect the change in the magnetic field caused by the eddy currents induced within the disk. The trainer additionally includes a processor configured to receive input from the sensor system reflecting the detected change in the magnetic field. The processor determines the power provided by a user of the trainer based on the input from the sensor system.

22 Claims, 2 Drawing Sheets

MAGNETIC RESISTANCE TRAINER POWER MEASUREMENT

TECHNICAL FIELD OF THE INVENTION

This invention relates in general to stationary exercise trainers and more specifically to devices equipped with magnetic resistance load providers.

BACKGROUND OF THE INVENTION

Various types of stationary exercise devices exist to allow individuals to train indoors instead of outdoors. Indoor training can have many benefits such as convenience and an ability to exercise and train even when outdoor conditions do not permit it. However, indoor training also has drawbacks. Due to changing terrain and conditions, outdoor training typically gives the person training a more varied and many times more difficult workout than indoor training. For example, bicycle riders may encounter hills and various types of surfaces as they ride on different roads and along different routes. The terrain and roads cause riders to exert more effort than they would have to if they were simply riding along a smooth, flat, straight, path, which is what some stationary exercise devices simulate.

To improve users' workouts, many stationary exercise devices employ a variety of methods to increase the resistance that users experience while exercising. Magnetic resistance training devices are one way to create this resistance.

Several magnetic resistance trainers that exist today provide users with a means of adjusting the resistance provided by the trainers. However, the trainers do not provide a means for users to determine their power output while using the trainers. A user of a magnetic resistance trainer may use power determinations to tailor a workout that meets that particular user's fitness needs and goals.

SUMMARY OF EMBODIMENTS OF THE INVENTION

From the foregoing, it may be advantageous to provide a way for a user of a magnetic resistance trainer to monitor the power being provided by the user while using the trainer. In accordance with the present invention, a method and system of determining a user's power output while using a magnetic resistance trainer is provided.

In accordance with a particular embodiment of the present invention, a magnetic resistance trainer includes an electrically conductive disk, a magnet, a sensor system, a processor and a monitor. The electrically conductive disk is configured to rotate in response to power provided by a user of the trainer. The magnet is configured to create a magnetic field. The magnet is further configured to be positioned proximate to the disk such that the magnetic field induces eddy currents in the disk when the disk is rotating. The sensor system is configured to detect a change in the magnetic field caused by the eddy currents in the disk. The processor is configured to receive input from the sensor system reflecting the detected change in the magnetic field. The processor also determines the power provided by the user based on the input from the sensor system. The monitor is configured to receive the power determination from the processor and display the power provided by the user.

In another embodiment the processor may determine a user's energy expenditure. For example, the user's calorie expenditure may be calculated using the power determination as a parameter along with other factors well known in the art. The monitor may be configured to receive and display the user's calorie expenditure.

Technical advantages of particular embodiments of the present invention include an ability to determine the amount of power provided by a user while using a magnetic resistance trainer. The power may be displayed in units of power, such as watts or horsepower. The power may also be used to calculate other useful information such as calories burned by the user. Thus, a user can better tailor an exercise program to meet that particular user's fitness needs.

Other technical advantages will be readily apparent to one skilled in the art from the following figures, descriptions, and claims. Moreover, while specific advantages have been enumerated above, various embodiments may include all, some or none of the enumerated advantages.

BRIEF DESCRIPTION OF THE DRAWINGS

To provide a more complete understanding of the present invention and the features and advantages thereof, reference is made to the following description, taken in conjunction with the accompanying drawings in which.

DETAILED DESCRIPTION OF THE INVENTION

Magnetic resistance trainers create resistance by using the principles of electromagnetism. When an electrically conductive material moves through a magnetic field, electrical currents are produced within that material. These currents are called eddy currents. The eddy currents create a second magnetic field, which opposes the original magnetic field. The force created by the interaction between the two magnetic fields opposes the direction the electrically conductive material is moving, thus making it harder to continue moving the electrically conductive material in the same direction.

The amount of power required to overcome the force created and continue moving the electrically conductive material through the magnetic field may be determined. The magnetic field created by the eddy currents also causes a disturbance and change in the original magnetic field. The change in the original magnetic field may be detected using various sensors. The amount of power required to move the electrically conductive material through the magnetic field may be determined by finding a correlation between the power and the change in the original magnetic field.

The magnitude of the force opposing the electrically conductive material is dependent on various factors. One of these factors is the strength of the magnetic field acting on the electrically conductive material. The strength of the magnetic field acting on the electrically conductive material may be affected by many things including the strength of the magnet, the proximity of the magnet to the electrically conductive material, the conductivity and nature of the electrically conductive material, and the rate at which the electrically conductive material passes through the magnetic field.

Figure 1:
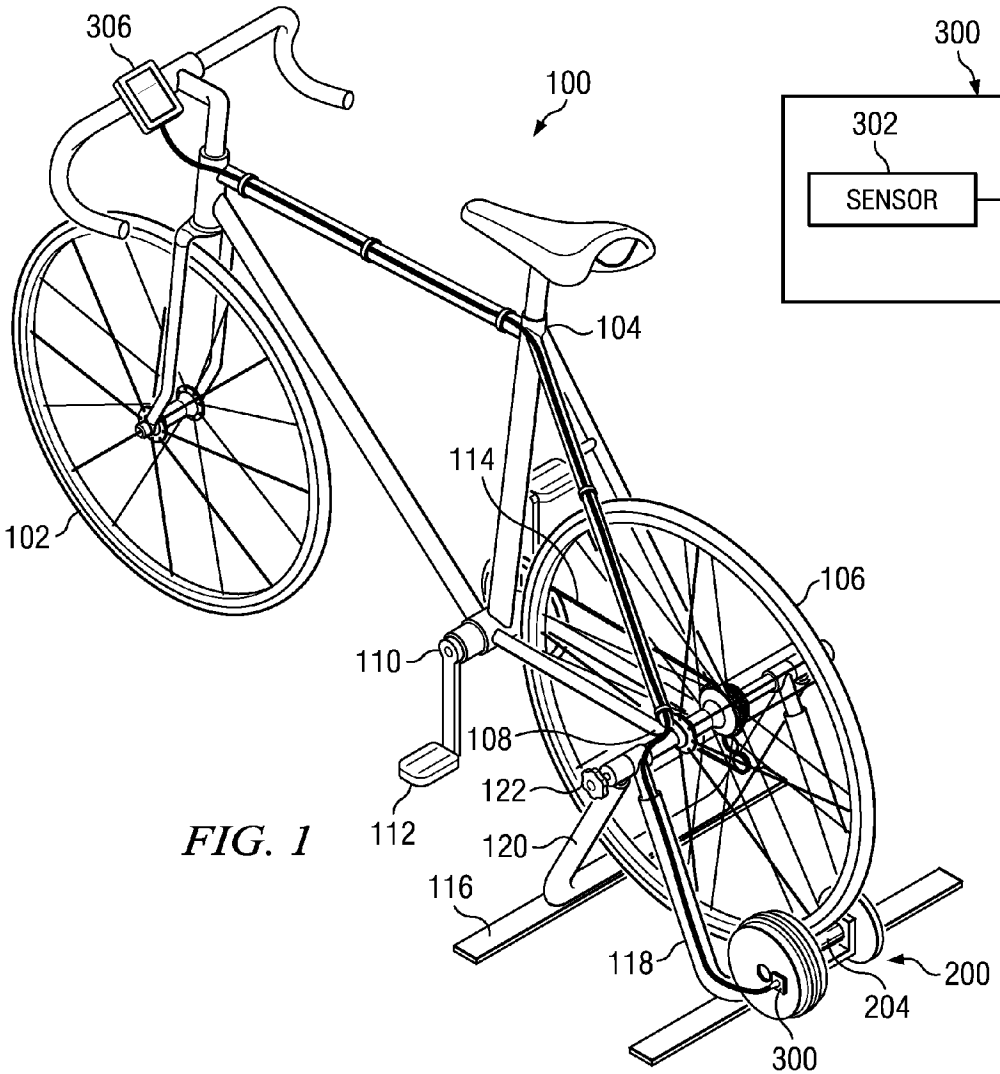
FIG. 1 is a drawing illustrating an embodiment of a magnetic resistance trainer used with a bicycle.

FIG. 1 illustrates an embodiment of using these electromagnetic principles in a magnetic resistance trainer. In FIG. 1, a magnetic resistance trainer 200 is used with a bicycle 100. Although magnetic resistance trainer 200 is shown being used with a bicycle, different embodiments of magnetic resistance trainer 200 may be used with other exercise training devices such as a rowing machine, a permanently stationary bicycle or an elliptical trainer. Bicycle 100 includes a front wheel 102, a bicycle frame 104, and a rear wheel 106. Rear wheel 106 is mounted to a bicycle frame 104 at a pivot 108. Rear wheel 106 is rotably coupled to a drive spindle 110 and pedals 112 by a continuous chain 114 in a manner well known in the art.

Magnetic resistance trainer 200 may be mounted to the lower portion of a rear support frame member 118 of a support frame 116. A front support frame member 120 and rear support frame member 118 are coupled at the ends to a support frame connection point 122. Bicycle 100 is mounted to support frame 116 by aligning pivot 108 with support frame connection point 122 and attaching bicycle frame 104 to support frame connection point 122. Bicycle 100 is mounted to support frame 116 so that rear wheel 106 touches shaft 204 of magnetic resistance trainer 200. Rear wheel 106 applies sufficient pressure to shaft 204 such that shaft 204 rotates when rear wheel 106 rotates, even when magnetic resistance trainer 200 creates a high level of resistance. Therefore, the resistance created by magnetic resistance trainer 200 may be transferred to rear wheel 106, making it harder for a user to pedal bicycle 100.

A sensor system 300 is coupled to magnetic resistance trainer 200. Sensor system 300 is further configured to send signals to a processor system 306, as will be explained in more detail.

Figure 2:
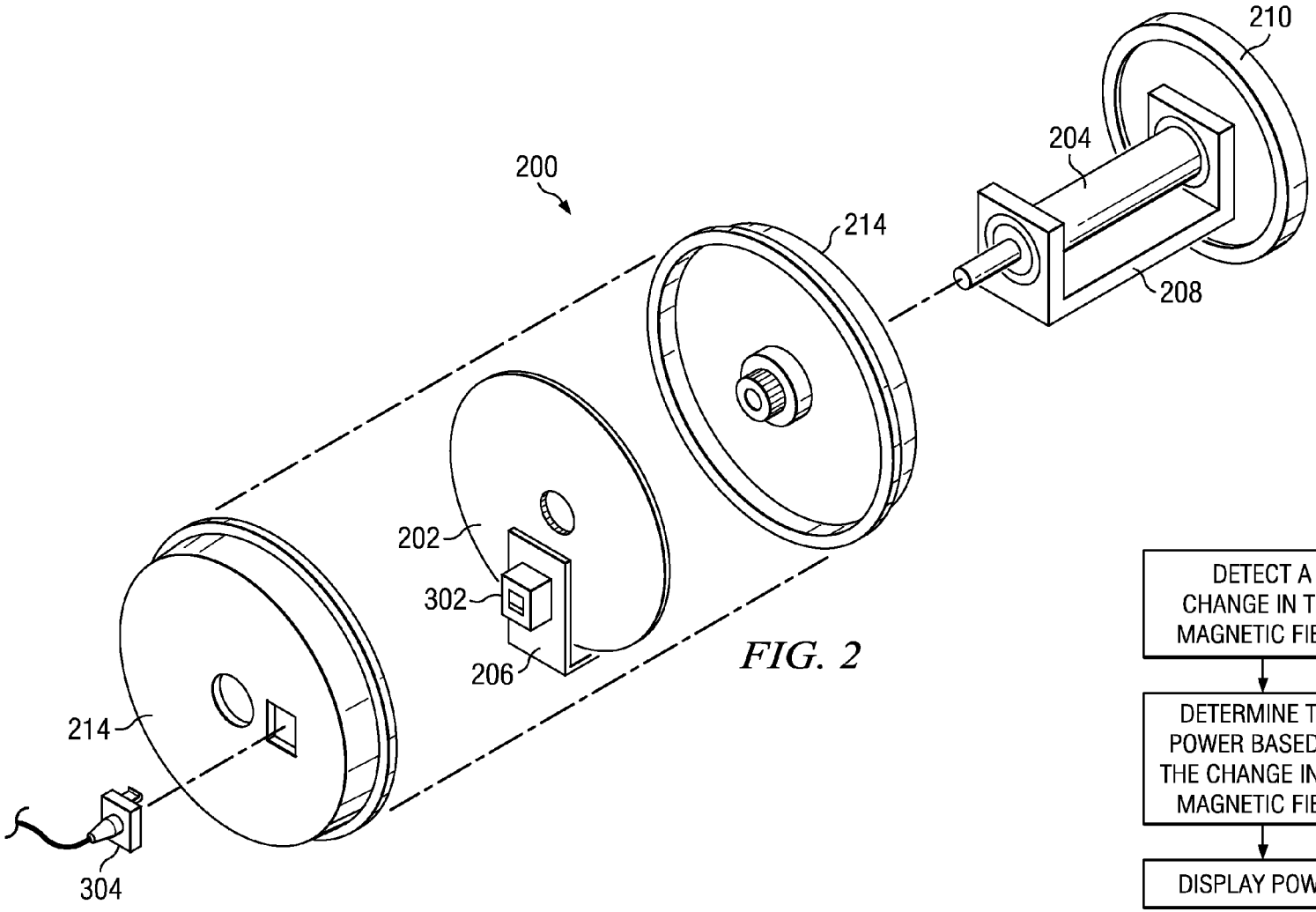
FIG. 2 is a drawing illustrating an exploded view of the magnetic resistance trainer of FIG. 1.

FIG. 2 represents an embodiment of magnetic resistance trainer 200. Magnetic resistance trainer 200 includes an electrically conductive disk 202. Electrically conductive disk 202 may be made out of aluminum or any other suitable, electrically conductive material found in the art. Electrically conductive disk 202 is rotably coupled to shaft 204 such that electrically conductive disk 202 rotates when shaft 204 rotates. As noted earlier, shaft 204 rotates when rear wheel 106 rotates and rear wheel 106 rotates when a user pedals bicycle 100. Thus, electrically conductive disk 202 rotates when a user pedals bicycle 100.

A bracket 208 is coupled to shaft 204 to hold shaft 204 in the correct position while also allowing shaft 204 to rotate. This may be accomplished using techniques well known in the art such as bearings. A flywheel 210 is rotably coupled to shaft 204, such that flywheel 210 also rotates when shaft 204 is rotating.

Magnetic resistance trainer 200 also comprises a magnet 206. Magnet 206 may be any material or object that creates a magnetic field such as a permanent magnet or an electromagnet. Magnet 206 is configured to be positioned proximate to electrically conductive disk 202 such that when disk 202 is rotating, the magnetic field created by magnet 206 induces eddy currents in electrically conductive disk 202. The eddy currents create a second magnetic field that opposes the first magnetic field created by magnet 206. This opposition makes it more difficult for electrically conductive disk 202 to rotate, thus providing the resistance to a user's input.

Magnet 206 may also be configured to allow the user to adjust the strength of the magnetic field acting on disk 202 by magnet 206. For example, magnet 206 may be configured to allow the user to adjust the distance between magnet 206 and electrically conductive disk 202. The strength of the magnetic field acting on electrically conductive disk 202 is proportional to the distance between electrically conductive disk 202 and magnet 206. The smaller the distance between the two, the greater the magnetic field acting on electrically conductive disk 202.

As another example, if magnet 206 is an electromagnet, magnet 206 may be configured to allow the user to adjust the resistance experienced. Electromagnets may be configured to allow the user to adjust the magnitude of the magnetic field created by the electromagnets. By adjusting the strength of the magnetic field acting on electrically conductive disk 202, the user may adjust the amount of resistance provided by the trainer.

Although magnet 206 is referred to as singular, it may constitute a plurality of magnets. For example, magnet 206 may be an array of magnets located at various positions proximate to electrically conductive disk 202. The array of magnets may create a stronger magnetic field that acts on electrically conductive disk 202. A stronger magnetic field makes it harder for electrically conductive disk 202 to rotate, therefore increasing the resistance experienced by the user. The array of magnets may also create a more uniform magnetic field around electrically conductive disk 202. A more uniform magnetic field may produce a more uniform resistance experienced by the user. The array of magnets may be an array of electromagnets or permanent magnets or a combination of both.

A sensor 302 is placed sufficiently close to magnet 206 to detect the magnetic field created by magnet 206. The circuitry 304 is configured to receive input from sensor 302 either wirelessly or by wire. Electrically conductive disk 202, magnet 206, sensor 302 and circuitry 304 are enclosed by an outer protective cover 212 and an inner protective cover 214.

Figure 3:
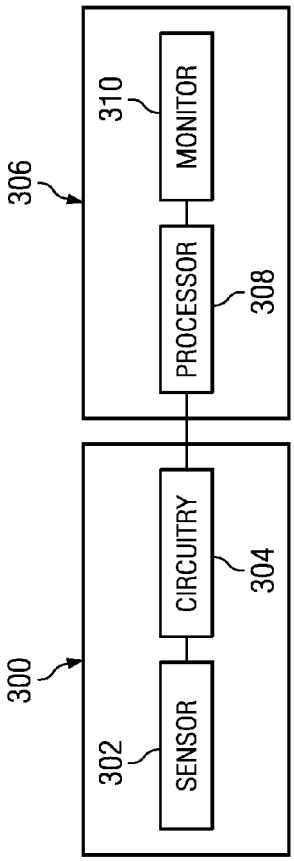
FIG. 3 is a block diagram illustrating selected elements suitable for use in measuring and determining the power provided by a user of a magnetic resistance trainer.

FIG. 3 is a block diagram illustrating selected elements suitable for use in measuring and determining the power provided by a user of a magnetic resistance trainer. Sensor system 300 may include sensor 302 and circuitry 304. Sensor 302 may be configured to detect a change in the first magnetic field created by magnet 206. As noted earlier, the change in the first magnetic field is caused by the second magnetic field created by the eddy currents in electrically conductive disk 202. Also, as previously discussed, the eddy currents are created when electrically conductive disk 202 is rotating, and electrically conductive disk 202 rotates in response to an input provided by a user.

Sensor 302 may be any device or circuitry configured to detect a change in a magnetic field. Changing magnetic fields may affect existing electromagnetic signals that are located within the magnetic fields. A changing magnetic field may also create electromagnetic signals in certain circuitry that is located within the magnetic field. Sensor 302 may detect the change in the magnetic field through the creation or manipulation of electromagnetic signals caused by the changing magnetic field. Sensor 302 may be a device or circuitry that creates electromagnetic signals when placed in a changing magnetic field. Sensor 302 may also be a device or circuitry with existing electromagnetic signals that are affected by a changing magnetic field.

Circuitry 304 may be configured to receive signals from sensor 302. Circuitry 304 may be further configured to manipulate the signals sent from sensor 302 into a signal that may be read and analyzed by the processor system 306. Circuitry 304 may be configured to receive and transmit signals either by wire or wirelessly.

Sensor system 300 may be any combination of sensor 302 and circuitry 304 used to detect or measure a change in a magnetic field and create a signal that may be read and analyzed by processor system 306.

An example of sensor system 300 may be an inductor coil with corresponding circuitry. Sensor 302 may be the inductor coil and circuitry 304 may be the corresponding circuitry. Magnet 206's magnetic field may change when electrically conductive disk 202 rotates. The changing magnetic field may induce a current within the inductor coil. The amount of change in the magnetic field may dictate the amount of current induced within the inductor. Therefore, the inductor coil may detect the change in the magnetic field by inducing a current. The corresponding circuitry may be implemented using methods well known in the art to facilitate detecting or measuring the change in the current caused by the changing magnetic field.

Either the change in the current or the rate of change in the current may be detected or measured. The change in the current or the rate of change in the current may correlate with the change or rate of change of the magnetic field. Additionally, the current may be used to determine the power provided by the user.

It may be more desirable to use voltage instead of current to determine the power provided by the user. Other circuitry may be implemented to detect or measure the voltage that corresponds with the current induced within the inductor, instead of detecting or measuring the actual current.

Another example of sensor system 300 may be a Hall Effect Sensor with corresponding circuitry. Sensor 302 may be the Hall Effect Sensor, and circuitry 304 may be the circuitry that corresponds with the Hall Effect Sensor. A Hall Effect Sensor is a transducer that varies its output voltage in response to changes in a magnetic field. When placed within the changing magnetic field of magnet 206, the Hall Effect Sensor may detect the changing magnetic field by having a varied voltage output that correlates with the changes in the magnetic field.

The Hall Effect Sensor may also include circuitry that facilitates detecting or measuring the varied voltage output. The change in the voltage may be detected or measured or the rate of change in the voltage may also be detected or measured. The voltage may be used to determine the power provided by the user.

Processor system 306 may comprise a processor 308 and a monitor 310. Processor system 306 may be configured to receive signals from sensor system 300 either wirelessly or by wire. Processor 308 is configured to receive input from sensor system 300 reflecting the change in the magnetic field. For example, if a Hall Effect Sensor is used, processor 308 may be configured to read the voltage sent to processor 308 by the Hall Effect Sensor. Processor 308 may further be configured to determine the power provided by the user based on the input from sensor system 300.

Processor 308 may determine the power provided by the user by using a correlation between the power provided to magnetic resistance trainer 200 and the signal given by sensor system 300. For example, a machine with an adjustable, known power output could be used to provide an input to magnetic resistance trainer 200. As previously explained, due to the power provided to magnetic resistance trainer 200, sensor system 300 creates a measurable signal. Multiple amounts of power may be provided as input by the machine and each particular signal from sensor system 300 may be measured and correlated with each particular power level provided. Therefore, a look up table correlating the power provided and signal strength may be created and stored within processor 308.

The look up table may be used to determine the power provided by a user. When a user is providing power to magnetic resistance trainer 200, sensor system 300 is sending a signal to processor 308. Processor 308 may determine which signal measurement stored in the look up table is closest to the signal being sent by sensor system 300 at that particular time. Processor 308 may then look up the power measurement stored in the look up table that correlates with that particular signal measurement value.

For example, assume that in the look up table 100 watts of provided power correlates with 10 volts provided by sensor system 300. Now suppose that a user is providing an unknown amount of power but sensor system 300 is sending processor 308 a signal of 10 volts. Processor 308 may use the look up table to determine that the user is providing 100 watts of power because 100 watts would correlate with a 10 volt signal sent to processor 308 by sensor system 300.

In another embodiment, the mathematical relationship between the amount of power provided and the signal given by sensor system 300 may be used to determine the amount of power provided by a user.

Processor 308 may use the determined power to calculate other data such as the amount of energy exerted by the user. For example, the amount of calories burned by the user while exercising may be calculated by using the power measurements along with other factors known in the art such as the user's height, weight, age, sex, time spent exercising, etc. Additionally, processor 308 may be configured to determine other useful exercise parameters such as time spent exercising, distance traveled, etc.

Processor 308 may also be configured to send information to monitor 310. The information may include power provided by the user in a unit of power such as watts or horsepower. The information may also include calories burned by the user, distance hypothetically travelled by the user, time spent exercising and the current resistance level. Processor 308 may send the signals to monitor 310 either by wire or wirelessly. Processor 308 may comprise hardware, software or a combination of both.

Processor 308 may be any digital or analog components configured to determine the power generated by a user. Processor 308 may determine the power generated by using the signal sent by sensor system 300. For example, the mathematical relationship between the voltage output of sensor 302 and power generated may be a simple scalar. An op-amp with a gain equivalent to the scalar may be used to amplify the signal sent from sensor system 300. The output voltage of the op-amp may be equivalent to the power generated by the user.

The amplified signal may then be sent directly to monitor 310. Monitor 310 may be a simple LED bar array that lights up certain levels according to the amount of voltage received. The corresponding amount of power generated by the user may be printed next to the LED levels. Therefore, processor 308 may simply be an op-amp used to determine the power generated by a user, as described in this example. In other embodiments other circuitry may be used as processor 308 to determine the power.

Monitor 310 is configured to receive and display the information sent by processor 308. Monitor 310 may be any type of interface that displays information to a user. For example, monitor 310 may be an LCD screen, or it may be an LED array.

Figure 4:
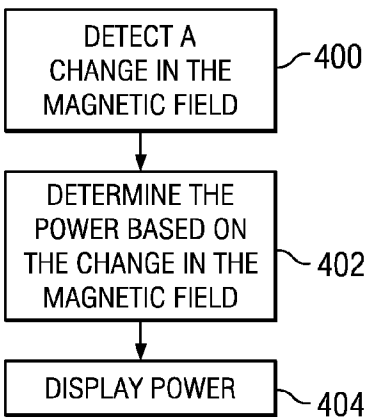
FIG. 4 is a flow diagram illustrating a method for measuring and determining the power provided by a user of a magnetic resistance trainer.

FIG. 4, is a flow diagram illustrating a method for measuring and determining the power provided by a user of a magnetic resistance trainer. The method begins at step 400 with detecting by a sensor the change in the original magnetic field caused by the eddy currents induced within disk 202. Step 402 continues by determining the power provided by the user based on the input from the sensor by using a processor configured to receive input from the sensor reflecting the detected change in the magnetic field. The method concludes in step 404 with displaying the power provided by the user by using a monitor.

Although the present invention has been described in detail with reference to particular embodiments, it should be understood that various other changes, substitutions, and alterations may be made herein without departing from the spirit and scope of the present invention. For example, although the present invention has been principally described with reference to a bicycle, the invention should not be limited to such. The present invention may be implemented in any resistance training device that generates a magnetic field. Numerous other changes, substitutions, variations, alterations, and modifications may be ascertained to one skilled in the art and it is intended that the present invention encompass all such changes, substitutions, variations, alterations, and modifications as falling within the spirit and scope of the appended claims.

What is claimed is:

1. A method of determining power provided by a user of a magnetic resistance training device comprising:

configuring an electrically conductive disk of a magnetic resistance training device to rotate in response to power provided by a user of the training device;

configuring a magnet to create a magnetic field used to generate a resistance to the rotation of the disk, the magnet configured to be positioned proximate the disk such that the magnetic field induces eddy currents in the disk when the disk is rotating;

detecting by a sensor system a change in the magnetic field caused by the eddy currents induced within the disk; and determining the power provided by the user based on input from the sensor system by using a processor configured to receive input from the sensor system reflecting the detected change in the magnetic field.

2. The method of claim 1, further comprising displaying by a monitor the power provided by the user.

3. The method of claim 1, wherein the power determination is used to determine the amount of energy exerted by the user.

4. The method of claim 3, wherein the energy exerted is calculated as calories burned.

5. The method of claim 3, further comprising displaying by a monitor the amount of energy exerted.

6. The method of claim 5, wherein the energy exerted is displayed as calories burned.

7. The method of claim 1, wherein the sensor system includes a Hall Effect Sensor.

8. The method of claim 1, wherein the sensor system includes an inductor coil.

9. The method of claim 1, wherein detecting the change in the magnetic field comprises detecting an electrical effect of the change in the magnetic field.

10. The method of claim 9, wherein the effect of the change in the magnetic field includes a change in current.

11. The method of claim 9, wherein the effect of the change in the magnetic field includes a change in voltage.

12. A magnetic resistance training device comprising:

an electrically conductive disk configured to rotate in response to power provided by a user of the training device;

a magnet configured to create a magnetic field used to generate a resistance to the rotation of the disk, the magnet configured to be proximate the disk such that the magnetic field induces eddy currents in the disk when the disk is rotating;

a sensor system configured to detect a change in the magnetic field caused by the eddy currents in the disk; and a processor configured to receive input from the sensor system reflecting the detected change in the magnetic field and determine the power provided by the user based on the input from the sensor system.

13. The system of claim 12, further comprising a monitor configured to display the power provided by the user.

14. The system of claim 12, wherein the processor uses the power determination to determine the amount of energy exerted by the user.

15. The system of claim 14, wherein the energy exerted is calculated as calories burned.

16. The system of claim 14, further comprising a monitor configured to display the energy exerted by the user.

17. The system of claim 16, wherein the energy exerted is displayed as calories burned.

18. The system of claim 12, wherein the sensor system includes a Hall Effect Sensor.

19. The system of claim 12, wherein the sensor system includes an inductor coil.

20. The system of claim 12, wherein the sensor system is configured to detect the change in the magnetic field by detecting an electrical effect of the change in the magnetic field.

21. The system of claim 20, wherein the effect of the change in the magnetic field includes a change in current.

22. The system of claim 20, wherein the effect of the change in the magnetic field includes a change in voltage.

* * * * *